US010724384B2

(12) United States Patent
Chuong et al.

(10) Patent No.: US 10,724,384 B2
(45) Date of Patent: Jul. 28, 2020

(54) INTERMITTENT TAB CONFIGURATION FOR RETAINING RING RETENTION

(71) Applicant: United Technologies Corporation, Farmington, CT (US)

(72) Inventors: Conway Chuong, Manchester, CA (US); Ross Wilson, South Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 689 days.

(21) Appl. No.: 15/253,957

(22) Filed: Sep. 1, 2016

(65) Prior Publication Data

US 2018/0058229 A1 Mar. 1, 2018

(51) Int. Cl.
*F01D 5/30* (2006.01)
*F01D 9/04* (2006.01)

(52) U.S. Cl.
CPC ..... *F01D 5/30* (2013.01); *F01D 5/3007* (2013.01); *F01D 5/3015* (2013.01); *F01D 9/042* (2013.01); *F05D 2220/32* (2013.01); *F05D 2230/60* (2013.01)

(58) Field of Classification Search
CPC ..... F01D 5/30; F01D 5/3007; F01D 5/3015; F01D 5/3023; F01D 5/326; F01D 5/34; F01D 9/042; Y10T 29/49321
USPC ..... 416/204 R, 215
See application file for complete search history.

(56) References Cited

U.S. PATENT DOCUMENTS 3,043,562 A * 7/1962 Fusner ..... F01D 5/3015 416/193 A
3,656,865 A 4/1972 Spears, Jr.
5,256,035 A * 10/1993 Norris ..... F01D 5/3015 416/220 R
5,257,909 A * 11/1993 Glynn ..... F01D 5/3015 416/219 R
5,302,086 A * 4/1994 Kulesa ..... F01D 5/3007 416/220 R
5,338,154 A 8/1994 Meade et al.
5,484,242 A 1/1996 Meyer
6,533,550 B1 * 3/2003 Mills ..... F01D 5/3015 416/220 R
7,197,807 B2 4/2007 Schoch et al.
(Continued)

FOREIGN PATENT DOCUMENTS

WO 2010067024 A2 6/2010

OTHER PUBLICATIONS

European Search Report for European Application No. 17188824.1, dated Jan. 29, 2018.

*Primary Examiner* — Richard A Edgar
*Assistant Examiner* — Maranatha Boardman
(74) *Attorney, Agent, or Firm* — Carlson, Gaskey & Olds, P.C.

(57) ABSTRACT

A component retaining assembly includes a housing including a circumferential slot. A component is mated to the housing. The component includes a first face including at least two tabs. The at least two tabs extending at outward from the first face at least partially past a portion of the circumferential slot. A retaining ring is disposed within the circumferential slot and abuts the first face of the component. The at least two tabs overlap a portion of the retaining ring. A gas turbine engine and a method are also disclosed.

18 Claims, 3 Drawing Sheets

(56) References Cited

U.S. PATENT DOCUMENTS

| | | | | |
|---|---|---|---|---|
| 7,244,105 | B2 * | 7/2007 | Moeller | F01D 5/3015 416/220 R |
| 7,371,050 | B2 | 5/2008 | Pasquiet | |
| 8,348,620 | B2 | 1/2013 | Dejaune et al. | |
| 8,956,119 | B2 * | 2/2015 | Chanteloup | F01D 5/326 416/193 A |
| 8,961,141 | B2 * | 2/2015 | Anderson | F01D 5/326 416/203 |
| 8,979,502 | B2 | 3/2015 | Paquet et al. | |
| 2011/0311366 | A1 * | 12/2011 | Chanteloup | F01D 5/326 416/220 R |
| 2012/0201681 | A1 | 8/2012 | Chauveau et al. | |
| 2013/0156589 | A1 | 6/2013 | Paquet et al. | |
| 2013/0323052 | A1 * | 12/2013 | Zhang | F01D 5/326 416/1 |
| 2014/0301849 | A1 | 10/2014 | Snyder | |
| 2015/0308488 | A1 | 10/2015 | Kahl | |

* cited by examiner

INTERMITTENT TAB CONFIGURATION FOR RETAINING RING RETENTION

STATEMENT REGARDING FEDERALLY SPONSORED RESEARCH OR DEVELOPMENT

This subject of this disclosure was made with government support under Contract No.: FA8650-09-D-2923-0021 awarded by the Air Force. The government therefore may have certain rights in the disclosed subject matter.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Retaining rings are utilized throughout a gas turbine engine to axially retain mated components. Typical retaining rings include a split that enables the ring to be forced open for assembly into a circumferential slot. The retaining ring remains within the slot due to the size and material characteristics that resist expansion. However, an improper size or material selection may enable the ring to become dislodged from the circumferential slot. Dislodgement of a retaining ring may free the mated components or become free within the rotating structures of the gas turbine engine.

Turbine engine manufacturers continue to seek further improvements to engine assembly and durability.

SUMMARY

In a featured embodiment, a component retaining assembly includes a housing including a circumferential slot. A component is mated to the housing. The component includes a first face including at least two tabs. The at least two tabs extending at outward from the first face at least partially past a portion of the circumferential slot. A retaining ring is disposed within the circumferential slot and abuts the first face of the component. The at least two tabs overlap a portion of the retaining ring.

In another embodiment according to the previous embodiment, the housing includes a back face and the component includes a second face spaced axially apart from the first face with the second face abutting the back face of the housing.

In another embodiment according to any of the previous embodiments, the at least two tabs are circumferentially spaced apart.

In another embodiment according to any of the previous embodiments, the retaining ring is disposed within a radial space between a bottom surface of the circumferential slot and the at least two tabs.

In another embodiment according to any of the previous embodiments, the circumferential slot is disposed within an inner diameter of the housing and the retaining ring is disposed radially outward of the at least two tabs.

In another embodiment according to any of the previous embodiments, the circumferential slot is disposed on an outer diameter of the housing and the retaining ring is disposed radially inward of the at least two tabs.

In another embodiment according to any of the previous embodiments, the retaining ring includes a split configured to enable expansion for assembly into the circumferential slot.

In another embodiment according to any of the previous embodiments, the component is fixed relative to the housing.

In another featured embodiment, a gas turbine engine includes a housing disposed about an engine axis. The housing includes a circumferential slot. A component is mated to the housing. The component includes at least two axially extending tabs. A retaining ring is disposed within the circumferential slot for axially retaining the component to the housing. The retaining ring is disposed within a radial space between the circumferential slot and the at least two axially extending tabs.

In another embodiment according to the previous embodiment, the component is fixed relative to the housing.

In another embodiment according to any of the previous embodiments, the housing is rotatable about the engine axis.

In another embodiment according to any of the previous embodiments, the housing defines a rotor and the component defines a portion of an airfoil assembly.

In another embodiment according to any of the previous embodiments, the retaining ring includes a split configured to enable expansion for assembly into the circumferential slot.

In another embodiment according to any of the previous embodiments, the circumferential slot is disposed within an inner diameter of the housing and the retaining ring is disposed radially outward of the at least two tabs.

In another embodiment according to any of the previous embodiments, the circumferential slot is disposed on an outer diameter of the housing and the retaining ring is disposed radially inward of the at least two tabs.

In another featured embodiment, a method of axially retaining a component to a housing includes defining the housing to include a circumferential slot. The component is defined to include at least two axially extending tabs. A first end of a retaining ring is inserted into a radial space between the circumferential slot and one of the at least two axially extending tabs. The first end is pushed within the circumferential slot until a second end of the retaining ring enters the circumferential slot and is disposed within the radial space.

Another embodiment according to the previous embodiment, includes abutting a first face of the component with the retaining ring for holding the component against a back face of the housing.

Another embodiment according to any of the previous embodiments, includes sizing the retaining ring to include an inner diameter corresponding with a bottom surface of the circumferential slot and a radial width less than a width of the radial space between the circumferential slot and the at least two axially extending tabs.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
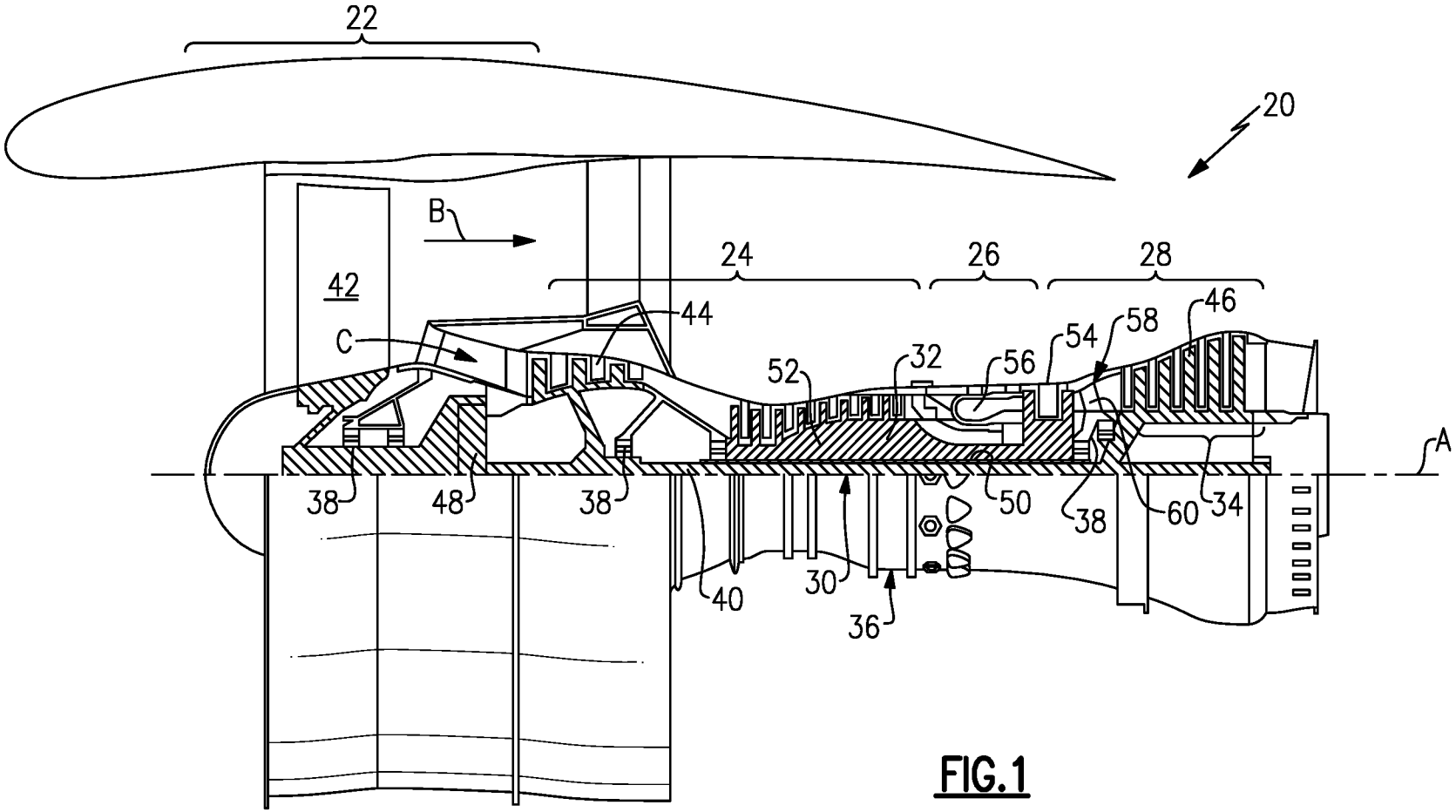
FIG. 1 schematically shows an embodiment of a gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high energy exhaust gas stream that expands through the turbine section 28 where energy is extracted and utilized to drive the fan section 22 and the compressor section 24.

Although the disclosed non-limiting embodiment depicts a two-spool turbofan gas turbine engine, it should be understood that the concepts described herein are not limited to use with two-spool turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects the fan section 22 and a low pressure (or first) compressor section 44 to a low pressure (or first) turbine section 46. The inner shaft 40 drives the fan section 22 through a speed change device, such as a geared architecture 48, to drive the fan 22 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

Airflow through the core airflow path C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

The example gas turbine engine includes the fan 22 that comprises in one non-limiting embodiment less than about 26 fan blades 42. In another non-limiting embodiment, the fan section 22 includes less than about 20 fan blades 42. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
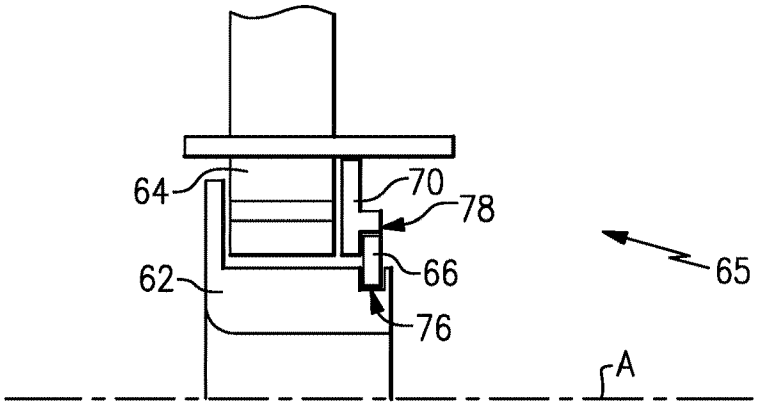
FIG. 2 schematically shows an embodiment of a retaining ring assembly securing an airfoil component.

Referring to FIG. 2 with continued reference to FIG. 1, a retaining ring assembly 65 is schematically shown for holding a component 64 within the housing 62. In this example, the housing 62 is a rotor and the component 64 is an airfoil. The example rotor 62 could be within the turbine section 28, the compressor section 24 or part of the fan section 22. The airfoil 64 could be a static vane or a rotating blade within the compressor section 24 or the turbine section 28. In any of these examples, the component 64 maintains a fixed orientation relative to the housing 62. In other words, the housing 62 and the component 64 remain in a specific static relative orientation relative to each other no matter if the housing 62 is rotating or is static feature.

The component 64 in this example is held within the housing 62 by a retaining ring 66. The example retaining ring 66 is disposed within a circumferential slot 76 defined within the housing 62. In this example, a backing plate 70 is used to abut against the component 64. The example backing plate 70 includes a tab 78 that is disposed within an axial space common with the retaining ring 66. Accordingly, the retaining ring 66 is disposed within a radial space between the bottom portion of the circumferential slot 76 and the tab 78. Because the retaining ring 66 is trapped within the radial space between the tab 78 and the circumferential slot 76, it is contained such that it may not move radially outward from the circumferential slot 76 in response to extreme G load events such as jerking or dropping or other extreme conditions encountered by the engine. Moreover, the tab 78 prevents the retaining ring 66 from coming loose of the circumferential slot 76 in response to thermal cycling expansion and contraction.

Figure 3:
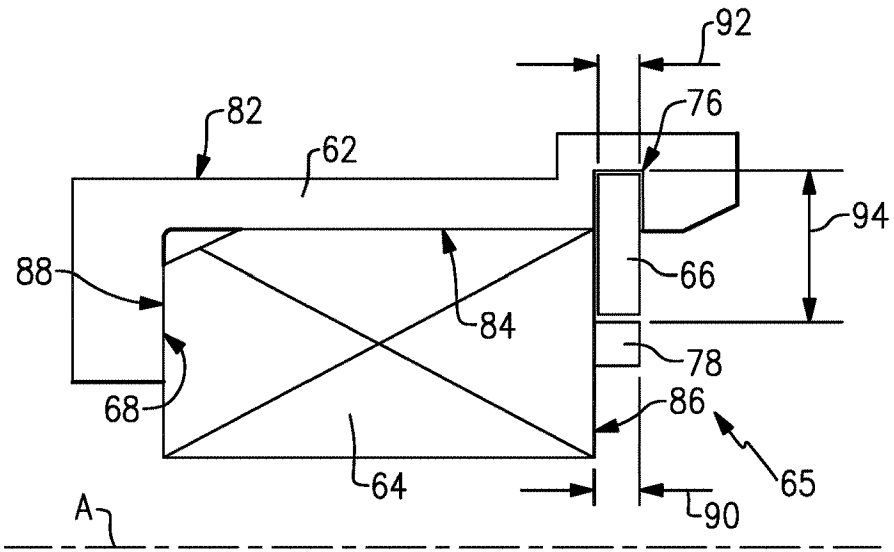
FIG. 3 is a cross sectional view of the retaining ring assembly.
Figure 4:
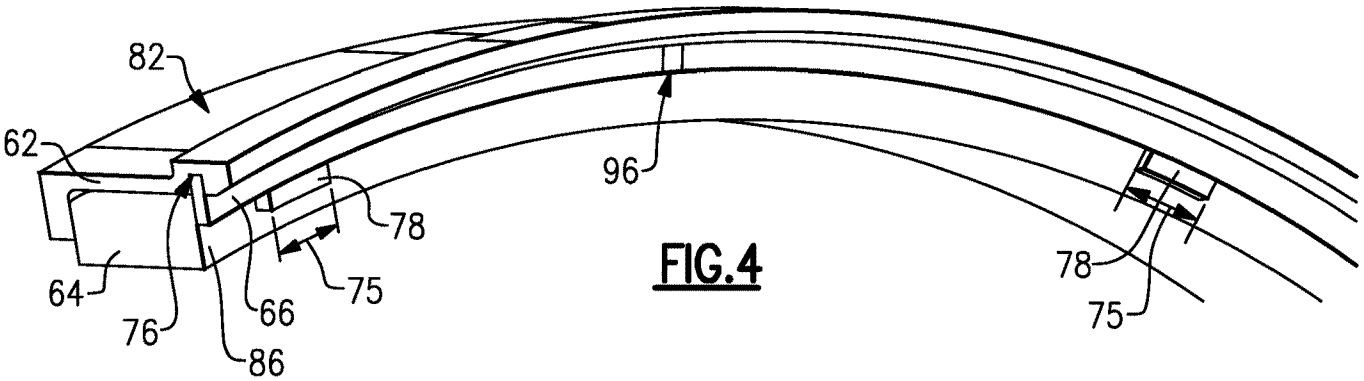
FIG. 4 is a perspective view of a portion of a retaining ring assembly.

Referring to FIGS. 3 and 4, the example retaining ring assembly 65 includes the retaining ring 66 that is disposed within the circumferential slot 76 defined within the housing 62. The housing 62 includes a back face 68. The component 64 includes a first face 86 from which at least two tabs 78 extend. In this example, the at least two tabs 78 extend axially a distance 90. The distance 90 corresponds to a width 92 of the retaining ring 66. The component 64 includes a second face 88 that abuts the back face 68 of the housing 62. In this example, the housing 62 includes an outer diameter surface 82 and an inner diameter surface 84. The component 64 is disposed on the inner diameter surface 84 and trapped axially between the back face 68 and the retaining ring 66.

The retaining ring 66 is disposed within a radial space 94 defined between a bottom surface of the circumferential slots 76 and the tab 78. The tab 78 extends axially a distance 90 from the first face 86. The distance 90 extends past a width 92 of the retaining ring 66. However, it is within the contemplation of this disclosure, that the tab 78 may extend a lesser or greater distance axially relative to a width of the retaining ring 66. The tab 78 need only extend a partial axial distance such that it overlaps the retaining ring 66.

Figure 5:
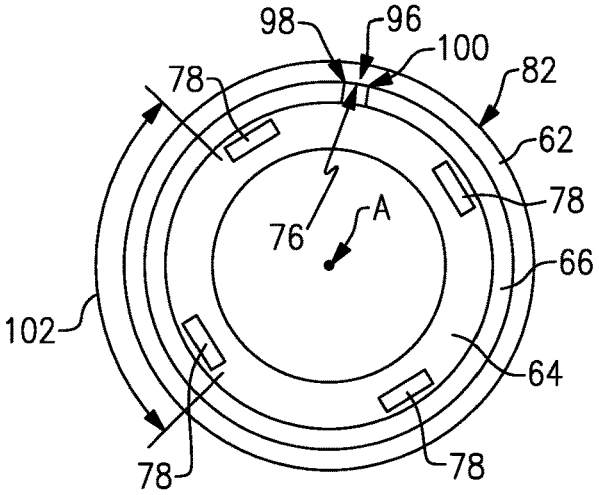
FIG. 5 is an axially looking view of the retaining ring assembly.

Referring to FIG. 5 with continued reference to FIGS. 3 and 4, the component 64 includes a plurality of tabs 78. In this example, the component 64 includes four tabs 78. However, the number of tabs 78 may vary and include at least more than two tabs 78 disposed circumferentially about the component 64. The tabs 78 are spaced a circumferential distance 102 apart from each other such that they are spaced about the circumference of the component 64.

The disclosed example embodiment includes the tabs 78 as an integral part of the component 64. The tab 78 may be a separate part that is attached to the component 64 during assembly. Accordingly, the tab 78 may be an integral part or a separable part that is assembled to the component 64. In either configuration, each of the tabs 78 are disposed such that they axially overlap the retaining ring 66 and constrain retaining ring 66 radially to maintain within the circumferential slot 76. The tabs 78 include a circumferential width 75 that provides sufficient material to contain the retaining ring 66 and provide sufficient structure to meet operational and durability requirements.

In the disclosed example illustrated in FIGS. 3, 4 and 5, the retaining ring extends radially inward from an inner diameter 84 of the housing 62. The retaining ring 66 is a split ring that includes a split 96 that enables assembly within the circumferential slot.

The split 96 enables the retaining ring 66 to be compressed or expanded to enable assembly into the circumferential slot 76. However, because the tabs 78 are included, the retaining ring 66 may not be expanded or contracted to be inserted into the circumferential slot 76. Instead, a first end 98 of the retaining ring 66 is inserted into the circumferential slot 76 within the radial space 94 and pushed within the circumferential slot 76 between the tabs 78 until the second end 100 is received within the circumferential slot 76. The split portion 96 may then be orientated relative to a circumferential location where one of the tabs 78 is present. Moreover, the split 96 may be orientated such that it is between adjacent tabs 78 as is illustrated in FIG. 4. In any of these orientations, the tabs 78 prevent radial movement of the retaining ring 66 out of the circumferential slot 76.

Figure 6:
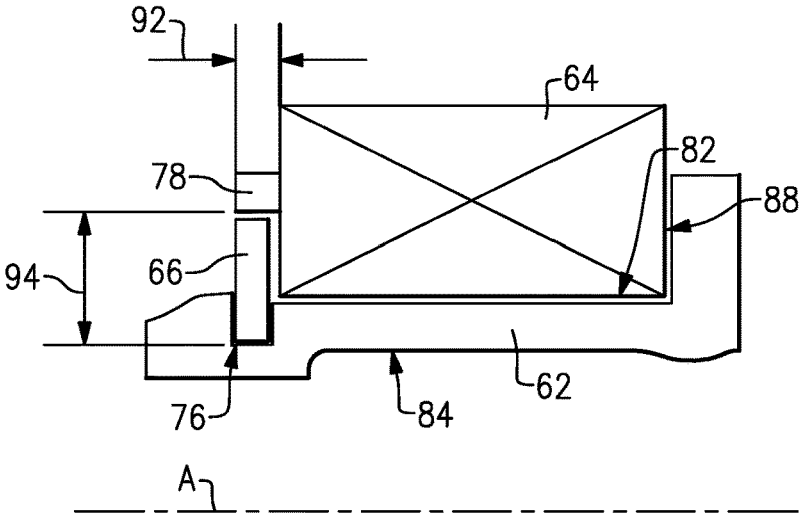
FIG. 6 is a cross section of another retaining ring assembly.
Figure 7:
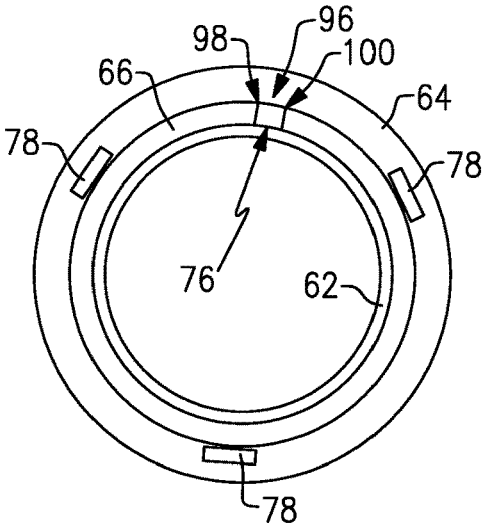
FIG. 7 is an axially looking view of the retaining ring assembly.

Referring to FIGS. 6 and 7, an alternate disclosed embodiment is illustrated where the component 64 is disposed on an outer diameter of the housing 62. In this example, the circumferential slot 76 is disposed on an outer diameter of the housing 62 and the retaining ring 66 is disposed within that circumferential slot. The component 64 is still abutted against a back face 68 of the housing 62. The retaining ring 66 remains confined within the radial space 94 between bottom of the circumferential slot 76 and the tab 78. Each of the tabs 78 extend a distance 92 that corresponds with an axial width of the retaining ring 66. In the example disclosed in FIG. 7, there are three tabs 78 disposed circumferentially apart. As appreciated, the specific number of tabs 78 may vary but will include two tabs 78 that are disposed in a circumferentially spaced manner to inhibit and constrain the retaining ring 66 to maintain it within the circumferential slot 76.

The example retaining ring assembly 65 includes the tabs 78 that contain and confine the retaining ring 66 within the circumferential slot 76 such that the retaining ring 66 is not susceptible to errant dislodgement during engine operation or in response to extreme conditions and circumstance.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A component retaining assembly comprising:

a housing including a circumferential slot, wherein the circumferential slot is continuous and uninterrupted about a circumference of the housing;

a component mated to the housing, the component including a first face including at least two tabs, the at least two tabs integral to the component and extending outward from the first face at least partially past a portion of the circumferential slot; and a retaining ring disposed within the circumferential slot and abutting the first face of the component, wherein the at least two tabs overlap a portion of the retaining ring.

2. The assembly as recited in claim 1, wherein the housing includes a back face and the component includes a second face spaced axially apart from the first face with the second face in abutting contact with the back face of the housing.

3. The assembly as recited in claim 1, wherein the at least two tabs are circumferentially spaced apart.

4. The assembly as recited in claim 1, wherein the retaining ring is disposed within a radial space between a bottom surface of the circumferential slot and the at least two tabs.

5. The assembly as recited in claim 1, wherein the circumferential slot is disposed within an inner diameter of the housing and the retaining ring is disposed radially outward of the at least two tabs.

6. The assembly as recited in claim 1, wherein the retaining ring includes a split configured to enable expansion for assembly into the circumferential slot.

7. The assembly as recited in claim 1, wherein the component is fixed relative to the housing.

8. A gas turbine engine comprising;

a housing disposed about an engine axis, the housing including a circumferential slot, the circumferential slot is continuous and uninterrupted about a circumference of the housing;

a component mated to the housing, the component including at least two integral axially extending tabs extending from a first face of the component; and a retaining ring disposed within the circumferential slot for axially retaining the component to the housing, the retaining ring disposed within a radial space between the circumferential slot and the at least two axially extending tabs.

9. The gas turbine engine as recited in claim 8, wherein the component is fixed relative to the housing.

10. The gas turbine engine as recited in claim 9, wherein the housing is rotatable about the engine axis.

11. The gas turbine engine as recited in claim 10, wherein the housing defines a rotor and the component defines a portion of an airfoil assembly.

12. The gas turbine engine as recited in claim 8, wherein the retaining ring includes a split configured to enable expansion for assembly into the circumferential slot.

13. The gas turbine engine as recited in claim 8, wherein the circumferential slot is disposed within an inner diameter of the housing and the retaining ring is disposed radially outward of the at least two tabs.

14. A method of axially retaining a component to a housing comprising:

defining the housing to include a circumferential slot disposed on an inner diameter of the housing, the circumferential slot is defined by first and second axial facing sides that are continuous and uninterrupted about a circumference of the housing;

defining the component to include at least two integral axially extending tabs extending from a first face of the component;

inserting a first end of a retaining ring into a radial space between the circumferential slot and one of the at least two axially extending tabs, wherein the retaining ring is inserted radially outward of the at least two tabs; and pushing the first end within the circumferential slot until a second end of the retaining ring enters the circumferential slot and is disposed within the radial space.

15. The method as recited in claim 14, including abutting the first face of the component with the retaining ring for holding the component in contact against a back face of the housing.

16. The method as recited in claim 14, including sizing the retaining ring to include an inner diameter corresponding with a bottom surface of the circumferential slot and a radial width less than a width of the radial space between the circumferential slot and the at least two axially extending tabs.

17. The assembly as recited in claim 1, wherein the circumferential slot is defined by first and second axial facing sides that are each continuous and uninterrupted about the entire circumference of the housing.

18. The assembly as recited in claim 8, wherein the circumferential slot is defined by first and second axial facing sides that are each continuous and uninterrupted about the entire circumference of the housing.

* * * * *